US008733577B2

(12) United States Patent
Patterson

(10) Patent No.: US 8,733,577 B2
(45) Date of Patent: May 27, 2014

(54) PRESENTATION COOLER

(71) Applicant: Adam Patterson, Barrington, NJ (US)

(72) Inventor: Adam Patterson, Barrington, NJ (US)

( * ) Notice: Subject to any disclaimer, the term of this patent is extended or adjusted under 35 U.S.C. 154(b) by 0 days.

(21) Appl. No.: 13/739,287

(22) Filed: Jan. 11, 2013

(65) Prior Publication Data

US 2013/0126537 A1 May 23, 2013

Related U.S. Application Data

(63) Continuation of application No. 13/624,192, filed on Sep. 21, 2012, now abandoned.

(60) Provisional application No. 61/537,312, filed on Sep. 21, 2011.

(51) Int. Cl.
*B65D 1/24* (2006.01)

(52) U.S. Cl.
USPC ..... 220/529; 220/592.01; 220/592.11; 220/592.21; 220/915.1; 220/915.2; 206/192; 280/655; 62/457.1; 62/457.7; 62/457.9

(58) Field of Classification Search
USPC ..... 220/529, 592.01, 592.11, 592.21, 220/915.1, 915.2; 280/655; 62/457.1, 62/457.7, 457.9
See application file for complete search history.

(56) References Cited

U.S. PATENT DOCUMENTS

| | | | | | |
|---|---|---|---|---|---|
| 4,119,248 | A * | 10/1978 | Butler et al. | ..... | 224/148.3 |
| 4,541,540 | A * | 9/1985 | Gretz et al. | ..... | 220/555 |
| 5,884,803 | A * | 3/1999 | Vine | ..... | 221/44 |
| 6,763,959 | B2 * | 7/2004 | Tedder | ..... | 211/188 |
| 7,066,347 | B2 * | 6/2006 | Slovak et al. | ..... | 220/754 |
| 7,284,763 | B1 * | 10/2007 | King | ..... | 280/47.26 |
| 2005/0109776 | A1 * | 5/2005 | Camp, Jr. | ..... | 220/23.86 |
| 2008/0179847 | A1 * | 7/2008 | DeFrancia | ..... | 280/47.26 |
| 2008/0245793 | A1 * | 10/2008 | Hanson et al. | ..... | 220/263 |

* cited by examiner

*Primary Examiner* — Fenn Mathew
*Assistant Examiner* — Elizabeth Volz
(74) *Attorney, Agent, or Firm* — Tarolli, Sundheim, Covell & Tummino LLP

(57) ABSTRACT

A cooler includes a bottom wall and a plurality of side walls connected to the bottom wall. At least one of the sidewalls has a transparent portion. A lid is connected to the side walls such that the bottom wall, side walls, and lid cooperate to define an interior space. At least one cup holder is formed in the bottom wall and positioned within the interior space. At least one first interior wall defines a receptacle within the interior space for receiving at least one of dry goods, food, and utensils. A second interior wall defines a chamber within the interior space for receiving cold items.

18 Claims, 5 Drawing Sheets

PRESENTATION COOLER

RELATED APPLICATIONS

This application is a continuation of U.S. patent application Ser. No. 13/624,192, filed Sep. 21, 2012, which claims the benefit of U.S. Provisional Application No. 61/537,312, filed Sep. 21, 2011. The entirety of each of the aforementioned applications is incorporated herein by reference.

TECHNICAL FIELD

The present invention relates to a cooler and, in particular, relates to a cooler that has transparent walls and a series of interior walls for defining wet and dry storage areas.

BACKGROUND

Coolers for beverages and storing ice are known in the art. Typically, the coolers are formed from four solid, plastic walls, a bottom wall, and a hinged lid. Collectively, the walls and lid define a storage chamber for storing ice, beverages, foodstuffs, etc. It may be desirable, however, to separate goods within the cooler such as utensils, food, ice, and beverages to more adequately control the temperature of each item. Furthermore, in locations where security is an issue, e.g., concert or sports venue, there is a need to search the contents of the cooler. This is problematic in that cold air can escape while the cooler lid is opened for inspection. Therefore, there is a need in the art for a compartmentalized cooler that allows the contents therein to be viewed without opening the lid.

SUMMARY OF THE INVENTION

In accordance with an embodiment of the present invention a cooler includes a bottom wall and a plurality of side walls connected to the bottom wall. At least one of the sidewalls has a transparent portion. A lid is connected to the side walls such that the bottom wall, side walls, and lid cooperate to define an interior space. At least one cup holder is formed in the bottom wall and positioned within the interior space. At least one first interior wall defines a receptacle within the interior space for receiving at least one of dry goods, food, and utensils. A second interior wall defines a chamber within the interior space for receiving cold items.

In accordance with another aspect of the present invention, a cooler includes a bottom wall and wheels connected to the bottom wall. A plurality of side walls are connected to the bottom wall. At least one of the sidewalls has a transparent portion. A lid is connected to the side walls such that the bottom wall, side walls, and lid cooperate to define an interior space. A plurality of cup holders is formed in the bottom wall and extends along at least one of the side walls. A plurality of first interior walls defines a plurality of receptacles within the interior space for receiving at least one of dry goods, food, and utensils. A second interior wall defines a substantially rectangular chamber within the interior space for receiving cold items, each receptacle being positioned adjacent a corner of the chamber.

Other objects and advantages and a fuller understanding of the invention will be had from the following detailed description of the preferred embodiments and the accompanying drawings.

DETAILED DESCRIPTION

Figure 1:
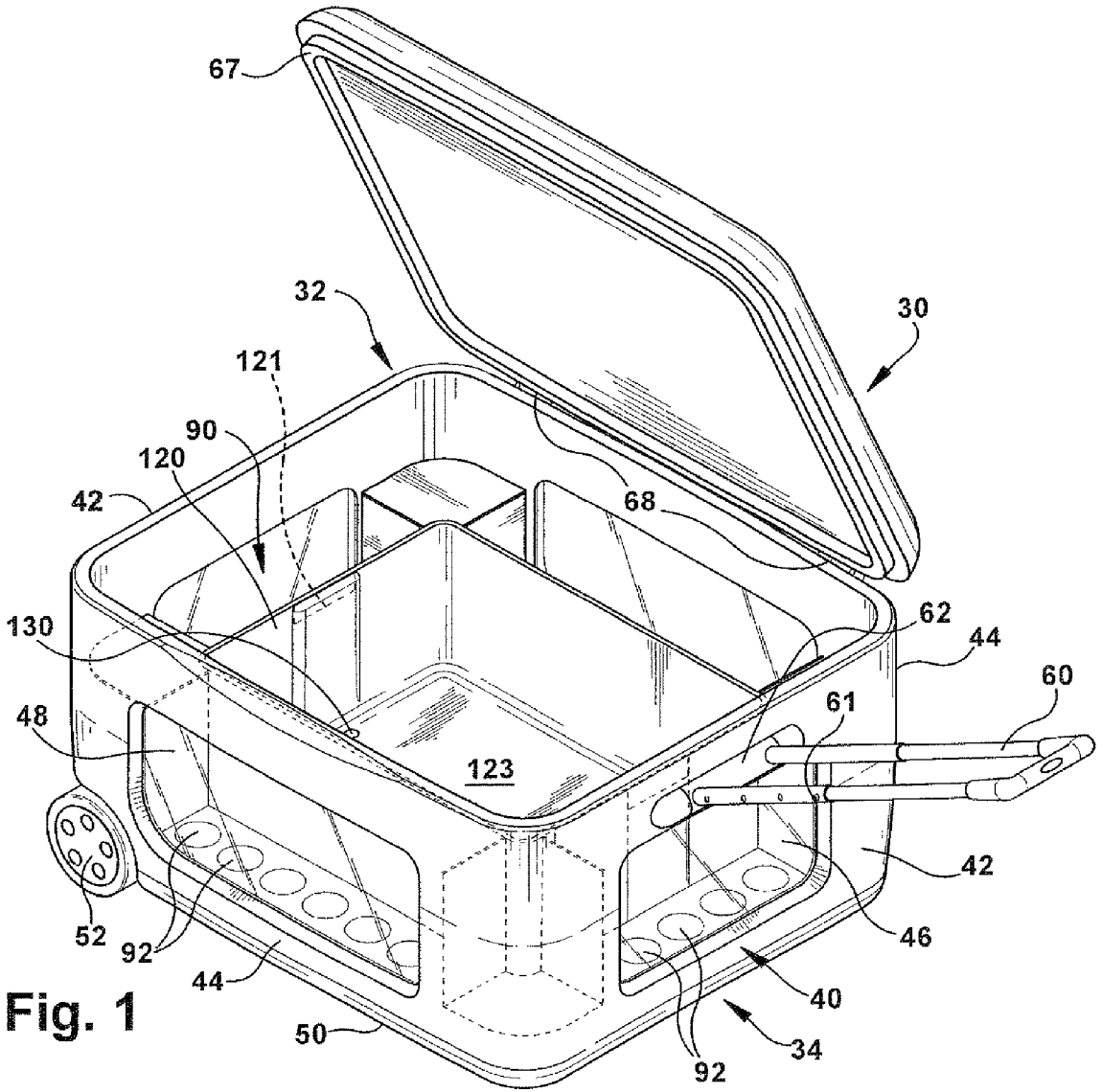
FIG. 1 is a schematic illustration of a cooler in accordance with an embodiment of the present invention.
Figure 2:
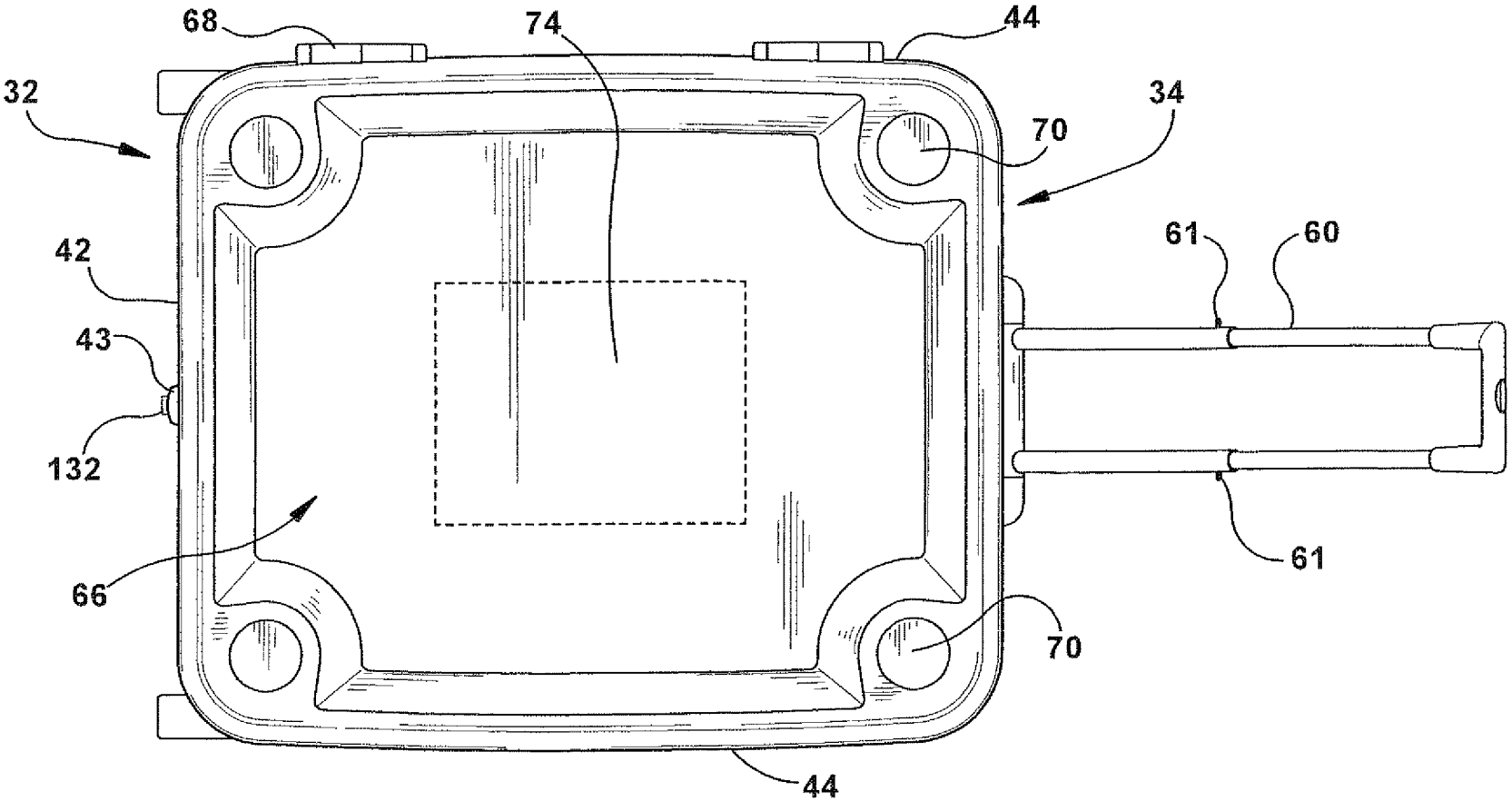
FIG. 2 is a top view of the cooler of FIG. 1.

The present invention relates to a cooler and, in particular, relates to a cooler that has transparent walls and a series of interior walls for defining wet and dry storage areas. A cooler 30 in accordance with an embodiment of the present invention is illustrated in FIGS. 1-4. As shown in FIGS. 1 and 2, the cooler 30 extends from a first end 32 to a second end 34 and includes a base 40 formed as a rectangle or square, although alternative shapes such as circular or any polygonal shape are contemplated. The base 40 includes a pair of first sidewalls 42 that extend substantially parallel to one another and a pair of second sidewalls 44 that extend substantially parallel to one another and connect the first sidewalls together. The sidewalls 42, 44 are formed from a durable, water-resistant material such as plastic. The side walls 42, 44 may be integrally formed with one another or separately formed and secured together in a fluid-tight manner. A bottle opener 43 may be provided on one or more of the sidewalls 42, 44.

One or both first sidewalls 42 include a transparent portion 46 and/or one or both second sidewalls 44 include a transparent portion 48. The transparent portions 46, 48 are formed from a clear or translucent material, such as plastic, and provided on the respective side wall 42, 44 in a fluid-tight manner. Each transparent portion 46, 48 has a two-paned construction to ensure that the interior of the cooler 30 is properly insulated. As shown in FIG. 1, all four sidewalls 42, 44 include a respective transparent portion 46 and 48. Each transparent portion 46, 48 may form a majority of the respective sidewall 42, 44 or may form less than a majority of the sidewall. The transparent portions 46, 48 may be similar or dissimilar in size, shape, and position on the respective sidewall 42, 44. Each transparent portion 46, 48 may constitute a single element or a series of elements arranged about the respective sidewall 42, 44. As shown, each transparent portion 46, 48 is a single, substantially rectangular element occupying a majority of the respective side wall 42, 44.

A bottom wall 50 is secured to or integrally formed with the sidewalls 42, 44 to close the bottom end of the side walls in a fluid-tight manner. Wheels 52 are secured to the bottom wall 50 at the first end 32 of the cooler 30 to assist in transporting the cooler. When only one set of wheels 52 is provided, rubber feet 54 secured to the bottom wall 50 at the second end 34 of the cooler 30 prevent movement of the cooler when the cooler is placed on the ground. As shown in FIG. 1, two wheels 52 are provided on one end of the base 40 and two feet 54 are provided on the opposite end of the base.

Figure 3:
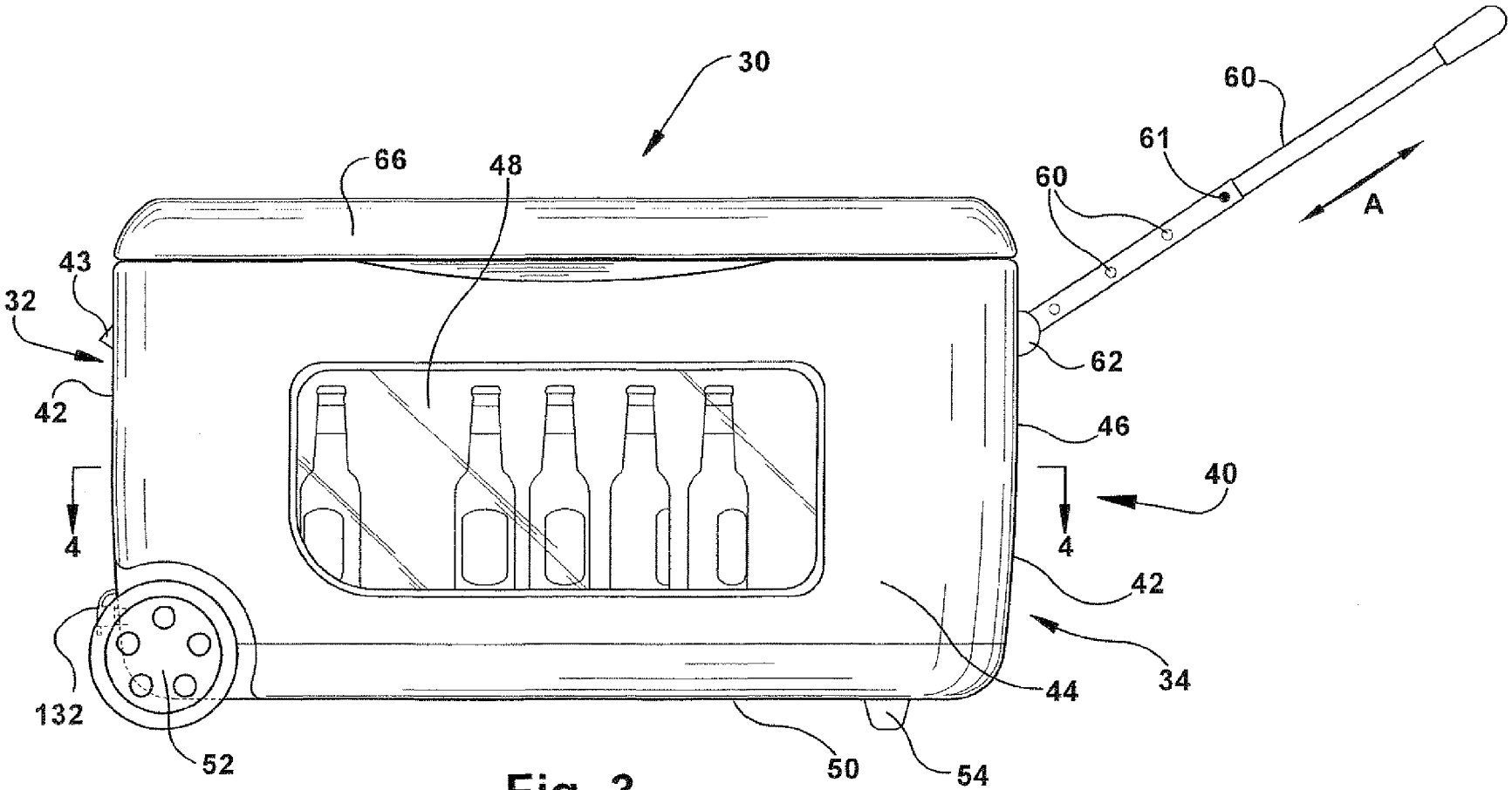
FIG. 3 is a side view of the cooler of FIG. 1.

Referring to FIG. 3, a handle 60 extends from one of the sidewalls 42 or 44 and away from the base 40. As shown, the handle 60 is provided on the side wall 42 and the second end 34 of the cooler 30 opposite the wheels 52. The handle 60 is connected to the base 40 by a hinge 62 that allows the handle to pivot up and down relative to the base. The handle 60 is formed by two concentric tubular members that telescope relative to one another and allow the user to adjust the length of the handle in the manner indicated generally by the arrow A. A locking mechanism 61, such as a spring-loaded pin, may be provided between the concentric tubes to lock the handle 60 at a desired length. Another locking mechanism (not shown) may be provided on the hinge 62 to lock the handle 60 at a desired angle relative to the base 40. The handle 60 may be configured to collapse and fold via the hinge 62 into a stored position against the adjacent sidewall 42 to which it is attached. A substantially identical handle (not shown) may also be secured to the side wall 42 at the first end 30 of the cooler 30 to allow the user to pull the cooler in either direction. Alternatively or additionally, conventional loop handles made of nylon or the like (not shown) may be secured directly to the sidewalls 42, 44 for carrying the cooler 30.

As shown in FIGS. 1-2, a lid 66 is secured to the top of the sidewalls 42, 44 opposite the bottom wall 50 by a hinge 68 that allows the lid to pivot relative to the base 40. One or more cup holders 70 are formed in the top surface of the lid 66 for holding cups, cans, bottles, etc. Indicia, indicated generally at 74 in FIG. 2, such as text or a design, e.g., the user's name, a sports team name or emblem or the cooler manufacturer, may be provided on the top surface of the lid 66. The lid 66 includes a seal 67 that mates with the top of the sidewalls 42, 44 to provide a fluid-tight seal between the lid and the sidewalls. A lock (not shown) may be secured to the side wall 44 and lid 66 to allow the cooler to be locked when desired.

Figure 4:
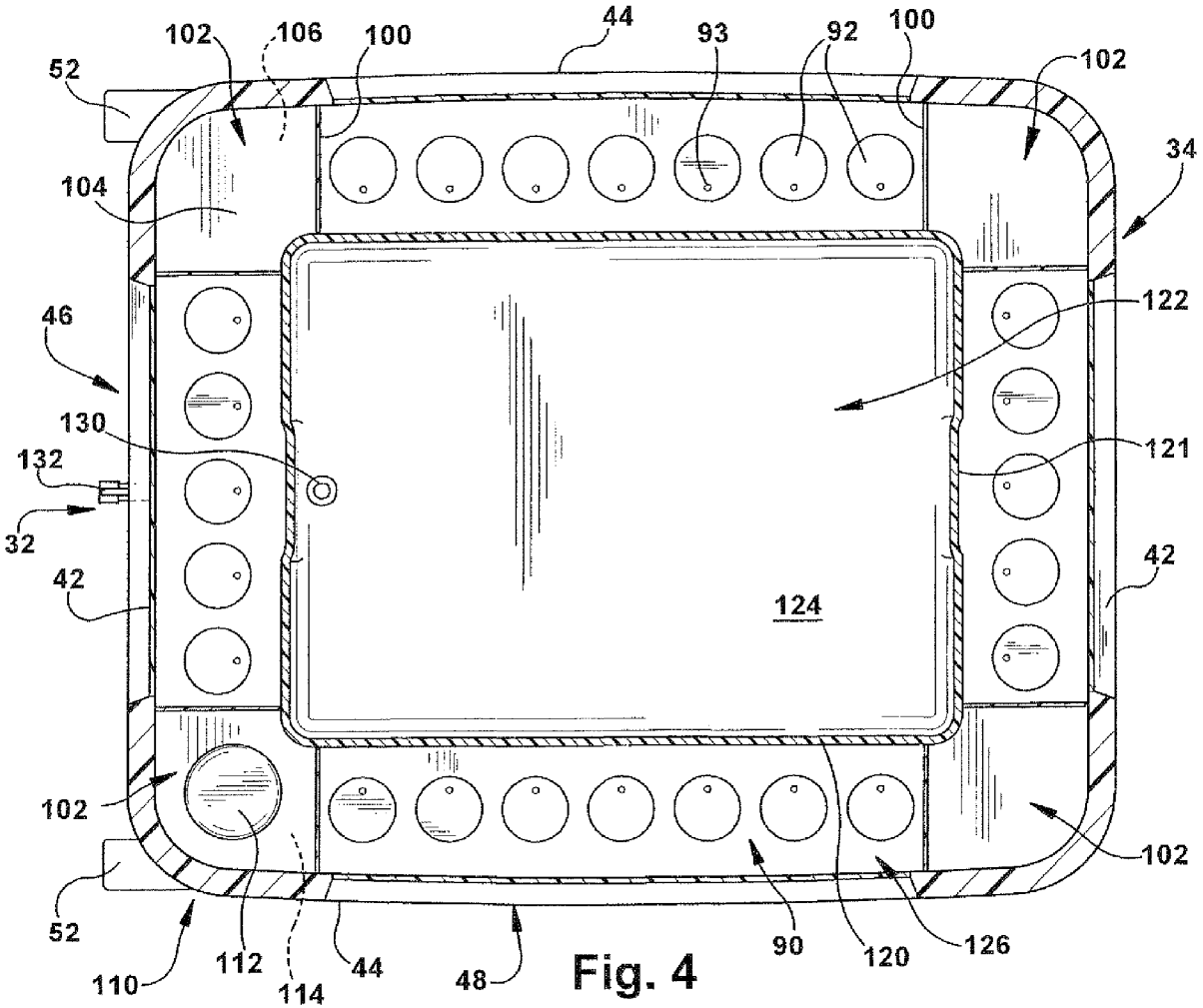
FIG. 4 is a top view of the cooler of FIG. 1 in which the lid of the cooler is open.

The sidewalls 42, 44, lid 66, and bottom wall 50 cooperate to define an interior space 90 of the base 40. As shown in FIG. 4, the interior space 90 has a rectangular shape with four corners. One or more cup holders 92 are formed in the bottom wall 50 within the interior space 90 for holding cups, cans, bottles or the like. In one example, the cup holders 92 extend generally along both first sidewalls 42 and both second sidewalls 44, although other patterns or arrangements of the cup holders may be used. A drain 93 is associated with each cup holder 92 for draining any undesirable contents, e.g., spilled liquids or melted ice, from the cup holder. A liner (not shown) extends within the interior space 90 and across the bottom wall 50 and parts of the sidewalls 42, 44. The liner is formed from a waterproof material, such as rubber, to provide a fluid-tight seal between the bottom wall 50 and the sidewalls 42, 44.

As shown in FIG. 4, an interior wall 120 having a bottom wall 123 secured thereto is connected to the bottom wall 50 of the cooler 30 to define a separate chamber 122 within the interior space 90. Alternatively, the bottom wall 123 is omitted and the bottom wall 50 helps to define the chamber 122. The interior wall 120 may be formed from a single piece or multiple pieces connected together in a desired configuration. In one instance, the bottom wall 50 is provided with a series of grooves or slots (not shown) that cooperate with the interior wall 120 and/or bottom wall 123 to allow the user of the cooler 30 to place the chamber 122 in a desired position within the interior space 90. The interior wall 120 may be formed with handles 121 to facilitate manipulation of the interior wall and allow the user to easily remove the interior wall from the cooler 30 for cleaning, etc. Due to this configuration, the interior wall 120 (and bottom wall 123, where applicable) can for manufactured to exhibit different colors and/or designs, e.g., for a particular team, which would allow the user to buy several different team design schemes and remove/replace the interior wall to coincide with the team playing on a specific occasion. The chamber 122 acts as a reservoir for storing colder items, indicated generally at 124 in FIG. 4, such as ice, drinks, cold food, etc. The interior wall 120 is formed from a dishwasher-safe material to help prevent contamination of the items 124 therein.

A sealable drain 130 is provided in the bottom wall 50 in fluid communication with the chamber 122 for draining liquids from the chamber. An optional strainer (not shown) may be placed on or integrally formed with the portion of the bottom wall 50 that helps to define the chamber 122. The strainer allows for the passage of liquids, e.g., water, to the drain 130 but prevents larger items such as foodstuffs and bottlecaps from exiting the chamber 122.

A series of secondary interior walls or partitions 100 are provided within the interior space 90 and cooperate with the bottom wall 50 to define receptacles 102 for receiving dry goods 104 such as napkins, utensils, plates, cups, mini-bar tools, food products, etc. The interior walls 100 may be integrally formed with or secured to the bottom wall 50. Similar to the interior wall 120, the interior walls 100 may cooperate with grooves or slots in the bottom wall 50 (not shown) to allow for alternative configurations of the interior walls, if desired. In such a configuration, the sidewalls 42, 44 may also include similar grooves or slots to further secure the interior walls 100.

As shown, the interior walls 100 define four receptacles 102 positioned in the four corners of the base 40. One or more of the receptacles 102 may include a cup dispenser 110 for holding and dispensing cups 112. All of the receptacles 102 are closed and sealed by the closed lid 66, which mates flush with the top surface of the interior walls 100 and side walls 42, 44 defining the receptacles. Alternatively, each of the receptacles 102 may be provided with a cover, shown in phantom at 114, that closes the receptacles in a fluid-tight manner. Both the cover 114 and the interior walls 100 may be formed of a durable, dishwasher-safe material, such as plastic.

Referring to FIG. 4, the space 126 between the interior wall 120 defining the chamber 122 and the interior walls 100 forming the receptacles 102 may be filled with cold water or ice to help keep the contents of the cooler 30 cold over extended periods of time. A drain 132 is provided in one or more sidewalls 42, 44 and in proximity to the bottom wall 50 to allow the space 126 to be drained of ice and melted water when desired. The bottom wail 50 may also include conduits, passages or the like (not shown) to fluidly connect the drain 132 to the chamber 122 in order to help further drain the chamber. Each of the drains 93 associated with the cup holders 92 is also fluidly connected to the drain 132 by a series of conduits or passages (not shown) extending through the bottom wall 50 that allow liquids within the cup holders to be removed.

Figure 5:
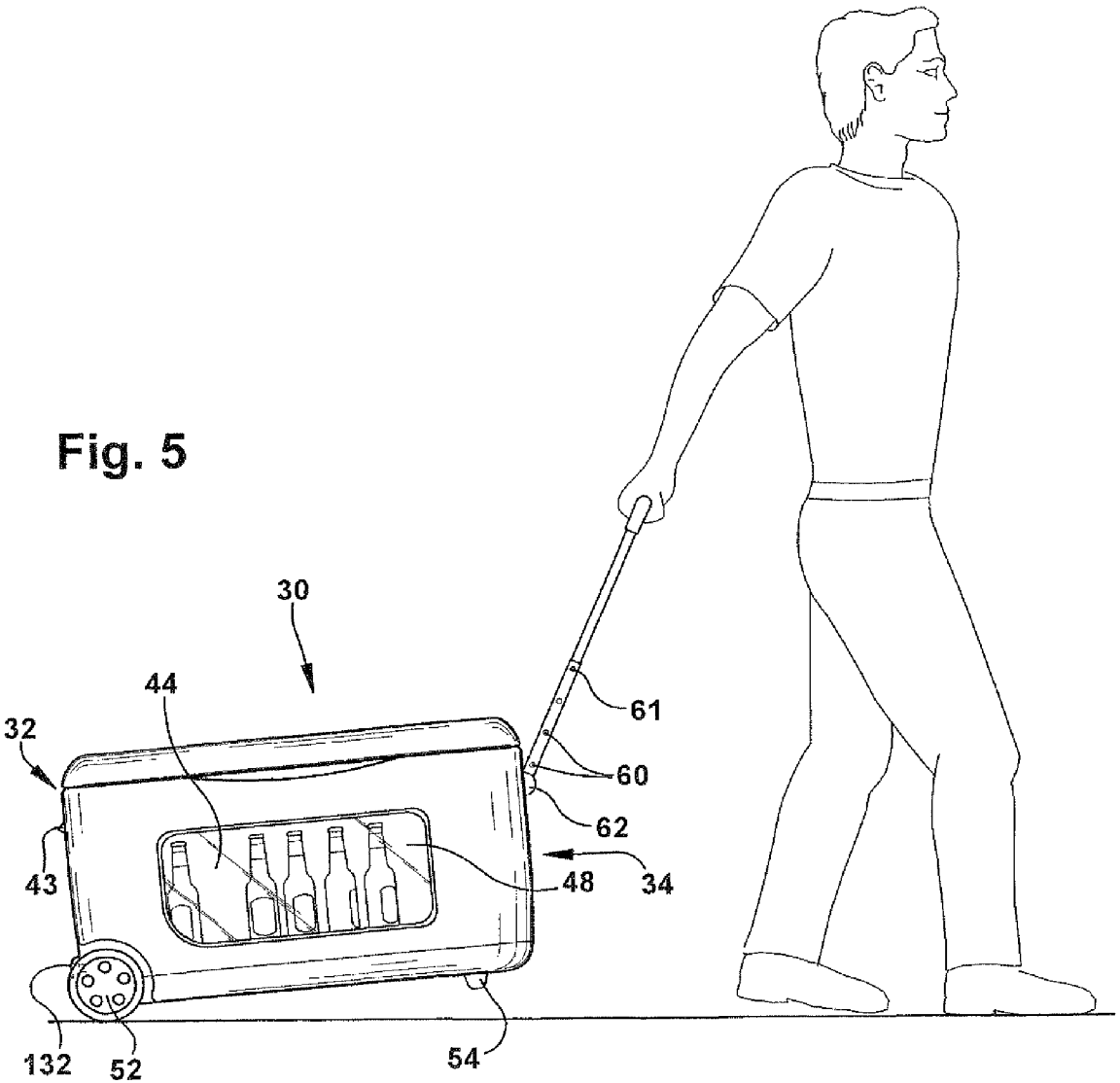
FIG. 5 is the cooler of FIG. 1 during transport.

To use the cooler 30, the user opens the lid 66 and fills any or all of the spaces 126 and/or chamber 122 with items corresponding to that particular location, e.g., dry goods 104 in the receptacles 102, beverage containers in the cup holders 70 within the interior space 90, and cold items 124 within the chamber 122 and the space 126. Any space 126 and chamber 122 is then filled with ice. The lid 66 is then closed, which closes and seals both the chamber 122 and the receptacles 102 as the lid sealingly mates with the top surfaces of the interior walls 100, 120 and side walls 42, 44 when in the fully closed condition. The cooler 30 can be transported by carrying via the loop handles on the sidewalls 42, 44 or via the wheels 52 by lifting and pulling the handle 60, as shown in FIG. 5. When the user wishes to access goods 104, 112 or 124 within the cooler 30, the lid 66 is opened via the hinge 68 and the goods retrieved from the receptacles 102, chamber 122 and/or space 126.

Since the sidewalls 42, 44 of the base 40 include transparent portions 46, 48, the contents of the spaces 126, e.g., within the cup holders 92, are viewable without opening the lid 66. This allows either the user or others, e.g., security at a sports venue, park or concert, to easily see the contents of the spaces 126 without opening the lid 66 of the cooler 30 and letting cold air escape. Once the cooler 30 reaches its destination, the handle 60 is lowered such that the feet 54 rest on the ground and inhibit further movement of the cooler. When the cooler 30 is stationary, the cup holders 70 on top of the lid 66 can be used to hold beverages. After use of the cooler 30 is finished, the drain(s) 130, 132 can be opened to release any melted ice or water from inside the space 124 of the cooler 30 to facilitate subsequent movement of the cooler.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims.

Having described the invention, the following is claimed:

1. A cooler comprising:

a bottom wall;

a plurality of side walls connected to the bottom wall, at least one of the sidewalls having a transparent portion;

a lid connected to the side walls such that the bottom wall, side walls, and lid cooperate to define an interior space having a corner defined by the side walls;

a plurality of cup holders formed in the bottom wall and positioned within the interior space;

at least one first interior wall that defines a receptacle in the corner of the interior space for receiving at least one of dry goods, food, and utensils; and a second interior wall that defines a chamber within the interior space for receiving cold items, the cup holders being located on opposite sides of the corner and arranged around the chamber.

2. The cooler of claim 1, wherein the at least one first interior wall comprises a plurality of first interior walls that define a plurality of receptacles.

3. The cooler of claim 1 further comprising a bottle opener secured to one of the side walls.

4. The cooler of claim 1 further comprising at least one cup holder formed into the lid.

5. The cooler of claim 1 further comprising a cup dispenser positioned within the receptacle.

6. The cooler of claim 1, wherein the second interior wall is spaced from the sides walls defining the interior space.

7. The cooler of claim 1 further comprising a sealable drain in fluid communication with the interior space for selectively draining the interior space.

8. The cooler of claim 7 further comprising a strainer lining the bottom wall for preventing clogging of the drain.

9. The cooler of claim 1 further comprising wheels connected to the bottom wall at a first end of the cooler for facilitating transport of the cooler.

10. The cooler of claim 9 further comprising feet connected to the bottom wall at a second end of the cooler opposite the first end.

11. The cooler of claim 9 further comprising a telescoping handle secured to one of the side walls at a second end of the cooler opposite the first end.

12. The cooler of claim 1, wherein the second interior wall is positioned within a slot in the bottom wall.

13. The cooler of claim 12, wherein the second interior wall includes a plurality of handles for removing the second interior wall from the interior space.

14. The cooler of claim 1, wherein the chamber has a substantially rectangular shape.

15. The cooler of claim 14, wherein the at least one first interior wall comprises a plurality of first interior walls that define four receptacles positioned adjacent each corner of the rectangular chamber.

16. A cooler comprising:

a bottom wall;

a plurality of side walls connected to the bottom wall, at least one of the sidewalls having a transparent portion;

a lid connected to the side walls such that the bottom wall, side walls, and lid cooperate to define an interior space;

a plurality of cup holders formed in the bottom wall and positioned within the interior space;

a plurality of first interior walls defining a plurality of receptacles within the interior space for receiving at least one of dry goods, food, and utensils; and a second interior wall that defines a chamber within the interior space for receiving cold items, the cup holders and receptacles being arranged in a rectangular pattern entirely surrounding the chamber for receiving cold items.

17. A cooler comprising:

a bottom wall;

a plurality of side walls connected to the bottom wall, at least one of the sidewalls having a transparent portion;

a lid connected to the side walls such that the bottom wall, side walls, and lid cooperate to define an interior space;

a plurality of cup holders formed in the bottom wall and positioned within the interior space;

a plurality of first interior walls defining a plurality of receptacles within the interior space for receiving at least one of dry goods, food, and utensils; and a second interior wall that defines a chamber within the interior space for receiving cold items, the cup holders being arranged around the chamber and cooperating with the plurality of receptacles to completely encircle the second interior wall.

18. A cooler comprising:

a bottom wall;

a plurality of side walls connected to the bottom wall, at least one of the sidewalls having a transparent portion;

a lid connected to the side walls such that the bottom wall, side walls, and lid cooperate to define an interior space having a plurality of corners;

a plurality of cup holders formed in the bottom wall and positioned within the interior space between a pair of the corners;

a plurality of first interior walls that define a receptacle at each of the pair of corners on opposing ends of the cup holders for receiving at least one of dry goods, food, and utensils; and a second interior wall that defines a chamber within the interior space for receiving cold items, the receptacles and the plurality of cup holders surrounding the chamber.

* * * * *